United States Patent [19]
Thomas et al.
[11] 4,317,549
[45] Mar. 2, 1982

[54] SNAP IN WIRE GUIDE HOUSING

[75] Inventors: O. Leon Thomas, Carrollton, Ga.; Eddie S. Baughn, Ranburne, Ala.

[73] Assignee: Southwire Company, Carrollton, Ga.

[21] Appl. No.: 141,096

[22] Filed: Apr. 17, 1980

[51] Int. Cl.[3] ..... B65H 57/06; B65H 57/26
[52] U.S. Cl. ..... 242/157 R; 226/196
[58] Field of Search ..... 242/157 R, 157 C; 226/196

[56] References Cited

U.S. PATENT DOCUMENTS

| | | | |
|---|---|---|---|
| 1,956,338 | 4/1934 | Bartling | 242/157 R X |
| 1,967,798 | 7/1934 | Witte | 242/157 R X |
| 2,464,664 | 3/1949 | Amon | 242/157 R |
| 3,389,844 | 6/1968 | Rossner | 226/196 |
| 3,646,746 | 3/1972 | Murray et al. | 242/157 R X |

FOREIGN PATENT DOCUMENTS

| | | | |
|---|---|---|---|
| 510486 | 1/1955 | Italy | 242/157 R |
| 201326 | 8/1923 | United Kingdom | 242/157 R |

*Primary Examiner*—Stanley N. Gilreath
*Attorney, Agent, or Firm*—Herbert M. Hanegan; Michael C. Smith; Stanley L. Tate

[57] ABSTRACT

Disclosed is a snap in wire guide housing constructed of an elastomer material for use in securing a conventional metallic wire guide to a metal housing.

8 Claims, 3 Drawing Figures

SNAP IN WIRE GUIDE HOUSING

BACKGROUND OF THE INVENTION

The present invention relates generally to wire making, and specifically to a wire guide housing constructed of an elastomer material in such a manner that a conventional metallic wire guide can be quickly snapped in or out.

Metallic wire guides are well known in the prior art. They are normally constructed of hardened metal for wear resistance, and are usually rigidly secured in a desired position to accurately guide the wire or cable during various processing steps.

One typical prior art method of securing wire guides has been to cement them in metal housings. This and other prior art methods, however, have inherent replacement problems causing excessive machine down time. In addition one specific portion of the wire guide will usually wear out before the rest because of static guide securement. High vibration and noise accompanies the prior art method of securing wire guides, causing machine component fatigue and health problems for machine operators.

SUMMARY OF THE INVENTION

The present invention solves these prior art problems. This invention is a wire guide housing constructed of an elastomer material in such a manner that a conventional metallic wire guide can be quickly snapped in or out, thus significatly reducing maintenance time and cost. Snap-in construction allows the metallic guide to creep in a rotational direction, thereby equalizing wear of the guide's wire contacting surface. Since the present invention is constructed of an elastomer material, vibration is dampened and noise is reduced.

Thus a major object of the present invention is to provide a wire guide housing constructed of an elastomer material in such a manner that a conventional wire guide can be quickly snapped in or out.

Another object of this invention is to reduce the cost and time consumed by wire guide maintenance.

Still another object of this invention is to extend wire guide life by promoting equalized wear of the wire guide's wire contact surface through creep rotation of the wire guide within the elastomer wire guide housing.

Yet another object of the present invention is to dampen vibration caused by wire passing through the wire guide.

Another object of this invention is to reduce noise associated with prior art wire guiding methods.

BRIEF DESCRIPTION OF THE DRAWINGS

While the specification concludes with claims particularly pointing out and distinctly claiming the subject matter which is regarded as the invention, it is believed that the invention, objects, features, and advantages thereof will be better understood from the following description taken in connection with the accompanied drawings in which like parts are given like identification numerals and wherein:

DESCRIPTION OF THE PREFERRED EMBODIMENT

Figure 1:
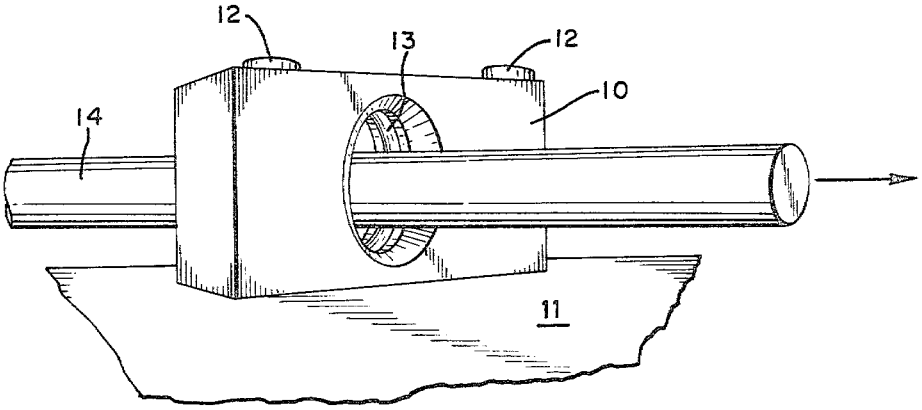
FIG. 1 is an elevation of the present invention in operation.

FIG. 1 illustrates the present invention in operation. The housing body 10 is secured to a frame member 11 by bolts 12. A conventional eyelet type metallic wire guide 13, having certain inner and outer diameters, is located in its snapped-in position inside the housing body 10 to guide the advancing wire 14.

The housing body 10 is constructed of an elastomer material such as nylon, polyurethane or ultra high molecular weight polyethlene. The flexibility of these materials allow the ring-like wire guide 13 to be quickly snapped into or out of position without disassembly of the housing body 10, thereby reducing machine down time. This flexibility also dampens vibration and reduces noise as well as allowing creep rotation of the wire guide 13 to prevent uneven wear of the wire guide's wire contacting surface.

Figure 2:
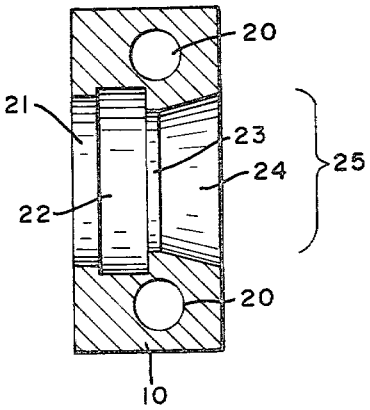
FIG. 2 is a cross-sectional overhead view of the present invention.

FIG. 2 is a cross-sectional top view of the housing body 10. This configuration may be accomplished by molding or machining. Bolt paths 20 are provided for the bolts 12 of FIG. 1. A central wire passageway 25 extends through said housing body 10. Concentric to the longitudinal axis of said wire passageway 25 are a wire entrance aperture 21, a wire guide groove 22, a wire guide stop 23, and a wire exit aperature 24.

The housing body 10 completely surrounds the wire passageway 25 in all lateral directions and thus also laterally surrounds the wire entrance aperture 21, the wire guide groove 22, the wire guide stop 23 and the wire exit aperture 24, which are all indivisible components of the housing body 10.

At one end of the housing body 10, is the circular wire entrance aperture 21 with a diameter slightly smaller than that of the wire guide 13 of FIG. 1. Inward of the wire entrance aperture 21 is the circular wire guide groove 22 with a diameter larger than that of the wire entrance aperture, yet only slightly larger than that of the wire guide 13. The elasticity of the housing body 10 material and the relationship of the wire entrance aperture 21 to the wire guide groove 22 allow the wire guide 13 to be quickly inserted or removed from the wire guide groove 22 by simply snapping it through the wire entrance aperture 21. Since the wire guide groove 22 is slightly larger in circumference than the wire guide 13, the wire guide 13 is free to creep in a rotational direction inside the groove 22 as wire 14 of FIG. 1 passes through the wire guide 13, thereby promoting even distribution of wear over the inside surface of the wire guide 13.

While the wire entrance aperature 21 provides a slight barrier to movement of the wire guide 13 in a direction opposite to the direction of wire movement, a more significant barrier is required to prevent movement of the wire guide 13 in the direction of wire movement. This barrier is provided by the wire guide stop 23 which has an aperture much smaller than the outer diameter of the wire guide 13 to prevent accidental snapping of the wire guide 13 out of the housing body 10, and only slightly larger than the inner diameter of the wire guide 13 to prevent interference with the advancing wire. Adjacent to the stop 23 is the wire exit aperture 24 through which wire 14 exits the housing body 10.

Figure 3:
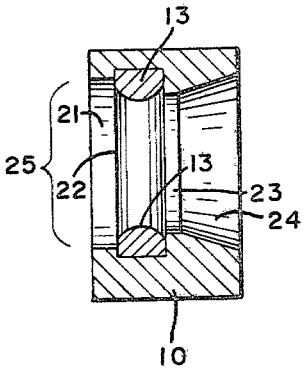
FIG. 3 is a cross-sectional side view of the present invention.

FIG. 3 is a cross-sectional side view of the housing 10 with the wire guide 13 positioned in the wire guide groove 22 to provide an even clearer illustration of component relationships.

While this invention has been described in detail with particular reference to a preferred embodiment thereof, it will be understood that variations and modifications can be effective within the spirit and scope of the invention as described hereinbefore and as defined in the appended claims.

What is claimed is:

1. A wire guide housing for holding an eyelet or ring-like wire guide having certain inner and outer diameters, said housing having; a body constructed of an elastomer material, means for attaching said body to a frame member; and a wire passageway extending through said body and having an inner surface adapted to grip the outer surfaces of said wire guide, comprising:

wire entrance means formed in said body adjacent to a first face of said body, completely enclosed laterally by said body and having an inner diameter slightly smaller than the certain outer diameter of said wire guide;

a wire guide retaining groove formed in said body adjacent to said wire entrance means, completely enclosed laterally by said body and having an inner diameter slightly larger than the certain outer diameter of said wire guide; wherein said wire guide retaining groove further comprises a circular compartment concentric to the longitudinal axis of said wire passageway, larger in diameter than said wire entrance means and slightly larger in diameter than said wire guide to provide an area within said body where said wire guide can be retained while allowing said wire guide to creep in a rotational direction within said groove as wire passes through said wire guide;

a wire guide stop formed in said body adjacent to said groove, sharing a trailing face of said groove as a leading stopping surface, completely enclosed laterally by said body and having an inner diameter smaller than the outer diameter of said wire guide and slightly larger than the inner diameter of said wire guide; and wire exit means formed in said body adjacent to said wire guide stop, completely enclosed laterally by said body, having an inner diameter no less than that of said wire guide stop and terminating at a second face of said body.

2. A wire guide housing for housing an eyelet wire guide having certain inner and outer diameters, comprising:

a body constructed of an elastomer material;

means for attaching said body to a frame member; and a wire passageway extending through said body, having an inner surface adapted to grip the outer surfaces of said wire guide and having; wire entrance means formed in said body adjacent to a first face of said body, said wire entrance means completely enclosed laterally by said body and having an inner diameter slightly smaller than the certain outer diameter of said wire guide; a wire guide retaining groove formed in said body adjacent to said wire entrance means, said groove completely enclosed laterally by said body and having an inner diameter slightly larger than the certain outer diameter of said wire guide; a wire guide stop, formed in said body adjacent to said groove, sharing a trailing face of said groove as a leading stopping surface, said stop completely enclosed laterally by said body and having an inner diameter smaller than the outer diameter of said wire guide and slightly larger than the inside diameter of said wire guide; and wire exit means formed in said body adjacent to said wire guide stop, said wire exit means completely enclosed laterally, by said body having an inner diameter no less than that of said wire guide stop and terminating at a second face of said body; wherein said wire entrance means, said wire guide retaining groove, said wire guide stop and said wire exit means are indivisible components of said elastomer body.

3. The apparatus of claim 1 or 2 wherein said elastomer material is nylon.

4. The apparatus of claim 1 or 2 wherein said elastomer material is polyurethane.

5. The apparatus of claim 1 or 2 wherein said elastomer material is ultra high molecular weight polyethylene.

6. The apparatus of claim 1 or 2 wherein said wire entrance means further comprises a circular entranceway concentric to the longitudinal axis of said wire passageway.

7. The apparatus of claim 1 or 2 wherein said wire guide stop further comprises an intermediate passageway portion concentric to the longitudinal axis of said wire passageway.

8. The apparatus of claim 1 or 2 wherein said wire exit means further comprises a terminating portion of said passageway concentric to the longitudinal axis of said passageway.

* * * * *